US010155256B2

(12) United States Patent
Becker et al.

(10) Patent No.: US 10,155,256 B2
(45) Date of Patent: Dec. 18, 2018

(54) METAL STRIP HAVING A CONSTANT THICKNESS AND VARYING MECHANICAL PROPERTIES

(75) Inventors: Jens-Ulrik Becker, Duisburg (DE); Harald Hofmann, Dortmund (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 1090 days.

(21) Appl. No.: 13/538,084

(22) Filed: Jun. 29, 2012

(65) Prior Publication Data

US 2012/0328899 A1 Dec. 27, 2012

Related U.S. Application Data

(63) Continuation of application No. PCT/EP2011/050984, filed on Jan. 25, 2011.

(30) Foreign Application Priority Data

Feb. 3, 2010 (DE) ..... 10 2010 000 292

(51) Int. Cl.
*B21B 1/22* (2006.01)

(52) U.S. Cl.
CPC ..... *B21B 1/22* (2013.01); *B21B 2205/02* (2013.01); *Y10T 428/12389* (2015.01); *Y10T 428/12458* (2015.01)

(58) Field of Classification Search
USPC ..... 148/418, 320; 428/418
See application file for complete search history.

(56) References Cited

U.S. PATENT DOCUMENTS

| | | | | |
|---|---|---|---|---|
| 7,067,023 | B2 * | 6/2006 | Kami et al. | 148/651 |
| 2006/0097549 | A1 | 5/2006 | Fischer et al. | |
| 2006/0174983 | A1 * | 8/2006 | Gerick et al. | 148/620 |
| 2007/0246137 | A1 | 10/2007 | Lequeu et al. | |

(Continued)

FOREIGN PATENT DOCUMENTS

| | | | |
|---|---|---|---|
| DE | 29913509 | U1 | 11/1999 |
| DE | 19840898 | A1 | 3/2000 |

(Continued)

OTHER PUBLICATIONS

NPL: English translation of Yamamoto Yasuhiro et al JP59082104, May 1984.*

*Primary Examiner* — Jie Yang
(74) *Attorney, Agent, or Firm* — Reinhart Boerner Van Deuren P.C.

(57) ABSTRACT

The invention relates to a metal strip which is produced from steel by hot rolling and by cold rolling of the metal strip. The invention also relates to a blank produced from the metal strip, the use of the metal strip, and to a method of producing it. The object of providing metal strip from which components of minimum weight which are adapted to specific loads can be produced with little cost or complication is achieved by metal strip of the generic kind which, after the cold rolling, is of constant thickness and has, section by section, regions whose mechanical properties vary. What "after the cold rolling" means, for the purposes of the present invention, is that, immediately on completion of the cold rolling, i.e. without any further treatment such as heat treatment, regions whose mechanical properties vary are present in the metal strip.

18 Claims, 2 Drawing Sheets

(56) References Cited

U.S. PATENT DOCUMENTS

| | | | | |
|---|---|---|---|---|
| 2009/0010793 | A1* | 1/2009 | Becker et al. | 420/38 |
| 2009/0058111 | A1 | 3/2009 | Perarnau Ramos et al. | |

FOREIGN PATENT DOCUMENTS

| | | | |
|---|---|---|---|
| DE | 19846900 | A1 | 4/2000 |
| DE | 102005031461 | A1 | 1/2007 |
| EP | 1238727 | A2 | 9/2002 |
| JP | 59082104 | A | 5/1984 |
| JP | 61284533 | A | 12/1986 |
| WO | WO 2009/095264 | A1 | 8/2009 |

* cited by examiner

METAL STRIP HAVING A CONSTANT THICKNESS AND VARYING MECHANICAL PROPERTIES

CROSS-REFERENCE TO RELATED PATENT APPLICATIONS

This patent application is a continuation of PCT/EP2011/050984, filed Jan. 25, 2011, which claims priority to German Application No. 102010000292.5, filed Feb. 3, 2010, the entire teachings and disclosure of which are incorporated herein by reference thereto.

FIELD OF THE INVENTION

The invention relates to metal strip which is produced from steel by the production of a hot-rolled strip by hot rolling and by cold rolling of the metal strip, and the invention also relates to a blank produced from the metal strip according to the invention and to the use of the metal strip and to a method of producing it.

BACKGROUND OF THE INVENTION

In motor vehicle construction, but also in many other areas of application where a minimum weight has to be met along with specific requirements for the mechanical properties of a component, it is often necessary, if the component is to be of the optimum design, for the mechanical properties of the blank or sheet from which the component is produced to vary. In the production of components from steel, in particular of structural components for motor vehicles, the use of so-called "tailored blanks" is known, where the components are produced from a blank which in turn consist of two sheets having different mechanical properties which are connected together on their face sides. In this way, as a result of the thickness varying while the grade of steel remains the same, it is for example possible to provide a higher strength in the region where the thickness is greater. Also, if the thickness of the material is kept the same, it is possible for one section of sheet to be produced from higher strength steel and for it to be welded to a less strong grade of steel of the same thickness. However, the production of tailored blanks is costly and complicated and requires additional steps in the operation including, amongst others, a laser welding step. As well as this, it is also known for there to be produced from hot-rolled strip, by flexible hot rolling but also by flexible cold rolling, hot-rolled or cold-rolled strip in the respective cases whose thickness varies section by section and which has differing mechanical properties in the specific regions due to the varying thickness. What is problematic about this process is that a strip whose thickness varies presents problems in handling and, this being the case, problems arise in the steps which have to be carried out in a process for manufacturing a component. A process of this kind is known for example from German published patent application DE 100 41 280 A1.

The object underlying the present invention is therefore to provide metal strip from which components of minimum weight which are adapted to specific loads can be produced with little cost or complication. The aim is also to propose a method of producing the metal strip, a blank produced from the metal strip and the specific use of the blank.

BRIEF SUMMARY OF THE INVENTION

According to a first teaching of the present invention, the object stated is achieved by metal strip which, after the cold rolling, is of constant thickness and has, section by section, regions whose mechanical properties vary. What "after the cold rolling" means for the purposes of the present invention is that, immediately on completion of the cold rolling, i.e. without any further treatment such as heat treatment, regions whose mechanical properties vary are present in the metal strip.

Due to the constant thickness of the metal strip after the cold rolling, blanks which have regions whose mechanical properties vary can be cut to size from the metal strip using conventional apparatus. There are no longer any difficulties in handling the metal strip. Also, the constant thickness is advantageous for the design of any forming tools which may be needed and also for the forming process itself. It is thus possible to produce, using simple means, a component which, despite being of the same wall thickness in different regions, has varying mechanical properties. This being the case, it is possible to produce from the metal strip according to the invention a blank which is suitably designed for its loads, which is of constant thickness and which manages without any additional welding processes such as for example with a tailored blank. There is no provision for a step-like change in thickness in the metal strip according to the invention and it can thus easily be wound into a coil and subject to further processing.

In a first embodiment of the metal strip according to the invention, the regions whose mechanical properties vary have different tensile strengths, yield points and/or elongations at rupture. By setting these mechanical properties in the different regions of the metal strip, it is possible to make allowance for different loading situations on the blank produced from the metal strip.

In a further embodiment of the metal strip according to the invention, the metal strip to be cold rolled is produced by flexible hot rolling, by flexible casting or by flexible cold rolling with subsequent annealing, so that before the cold rolling the metal strip has regions whose thicknesses vary, the regions of varying thickness have varying degrees of rolling-down after the cold rolling and, as an option, are in a periodic arrangement. What is thereby achieved is that, immediately after the cold rolling, the metal strip has been endowed with varying mechanical properties due to the different degrees of rolling-down in the cold rolling. Essentially, the varying degrees of rolling-down produce in the metal strip strengthenings whose extend is dependent on the material. What in particular is dependent on the material is the extent to which there is a relative change in tensile strength, yield strength and elongation at rupture at a given degree of rolling-down. The flexible casting may for example be carried out by the strip casting process with an in-line rolling pass or by the direct strip casting (DSC) process with in-line hot rolling. However, metal strip for cold rolling to a final thickness, which then has regions having undergone varying degrees of rolling-down, i.e. of varying mechanical properties, can also be made available by flexible cold rolling with subsequent annealing.

The regions whose mechanical properties vary are preferably in a periodic arrangement on the metal strip, thus making it possible for a large number of blanks suitably designed for their loads to be produced easily from the metal strip.

Advantageous behaviour by a component, but also by a blank, when being formed can be achieved by arranging, between the regions of the metal strip whose mechanical properties vary, transitional regions in which the mechanical properties, in particular the tensile strengths, yields points and/or elongations at rupture, at least partially change continuously. The transitional regions, between for example a region of high tensile strength and a region of lower tensile strength, can for example improve the behaviour of the blank when being formed since the blank has less tendency to develop cracks. The tendency to crack of formed components having similar transitional regions for the mechanical properties is likewise lower when under load. The width of the transitional regions is for example 50 mm or more. The degrees of rolling-down in the cold rolling, after for example the flexible hot rolling, may vary between 0 and 50%. However, it goes without saying that, to achieve a constant thickness, the regions of greater wall thickness have to undergo a degree of rolling-down of more than 0% in the cold rolling.

The thickness of the metal strip is preferably 0.5 mm to 3 mm. In such ranges, metal strip having mechanical properties which vary section by section can easily be produced by flexible hot rolling followed by cold rolling. When of this thickness, the metal strip itself is in particular well suited to structural applications in which there is a call for design suited to the loads.

In principle, any grade of steel is suitable for producing metal strip according to the invention although what are preferred are the grades of steel which strengthen highly. Advantageous embodiments of the metal strip according to the invention consist of high-manganese steels, stainless steels such as austenitic stainless steels or duplex stainless steels, retained-austenite steels or dual-phase steels, wherein the metal strip may preferably have an organic and/or inorganic coating. What may be considered as an inorganic coating is in particular galvanizing but as well as this an AlSi coating provided such a coating is desired. Compared with other grades of steel, the above-mentioned steels have in particular an appreciable increase in tensile strength and yield point in regions which have been subjected to a higher degree of rolling-down, without an excessively severe drop in the corresponding values for elongation at rupture. This is important for subsequent forming processes applied to the components and when use is made of the subsequent component. This effect is exploited to make available regions having a particularly high tensile strength and yield point.

According to a second teaching of the present invention, the object derived above is also achieved by a blank produced from metal strip according to the invention, the blank being of constant thickness, consisting of a single steel material and having, section by section, regions whose mechanical properties vary. The blank is therefore cut from the metal strip according to the invention in such a way that regions whose mechanical properties vary can be provided in a blank made of a single material immediately after the cold rolling. As a result of the deliberate selection and setting of the mechanical properties by way of the cold rolling, the blank can be suitably designed for its loads in such a way that it is matched in the optimum way to the purpose for which it is to be used. All this is done without any other additional materials, which in principle would detract from the recyclability of the blank and of components produced therefrom. This is in particular important in connection with the recycling of high-alloy steels. The blank may have a plurality of regions which have varying mechanical properties in order for it to be suitably designed for its loads.

A further advantageous embodiment of the blank according to the invention is obtained by giving the blank, between the regions whose mechanical properties vary, transitional regions in which the mechanical properties at least partially vary continuously. The transitions between regions having for example different tensile strengths are thus not abrupt but vary continuously, thus enabling the component produced to have advantageous properties in view of the possible loads to be absorbed, when being formed for example but also when being used as a structural component, and for example to have less of a tendency to crack.

The regions of the blank whose mechanical properties vary preferably have different tensile strengths, yield points and/or elongations at rupture. These properties can easily be set by means of the degree of rolling-down during the cold rolling and by means of the strengthenings produced thereby, thus enabling the blank to be produced easily by cutting to size from the cold-rolled metal strip. There is no longer any need for additional method steps for this purpose. The blank may of course also be organically and/or inorganically coated.

Finally, the object stated above is achieved in accordance with a third teaching of the present invention by a method of producing the metal strip from steel in which a metal strip having regions in which the thickness of the metal strip varies is produced from a steel slab by flexible hot rolling, by flexible casting or by flexible cold rolling with subsequent annealing, and the metal strip is cold rolled to a constant final thickness. As already mentioned, steel metal strips of varying thickness can be provided for the cold rolling to a final thickness by the alternative methods of production, thus enabling blanks having mechanical properties suitably designed for their loads to be produced inexpensively.

In an alternative form of this method, the roll gap is for example changed during the rolling process in the final hot rolling pass to produce hot-rolled strip having regions of varying thickness. During the cold rolling, the regions of greater thickness are rolled down to a greater extent and thus undergo greater strengthening than regions with a smaller degree of rolling-down. The strengthening results in a change in the mechanical properties and in particular in the tensile strength, the yield point and/or the elongation at rupture. As already stated, the changes in these mechanical properties are dependent on the material and may vary widely.

It has been found that, in a further embodiment according to the invention of the method, the degree of rolling-down in the cold rolling is preferably a maximum of 50% or a maximum of 20% in the regions of the hot-rolled strip which are of a greater thickness. In the regions of the hot-rolled strip which are of a greater thickness the degree of rolling-down must of course be more than 0% to give a constant final thickness for the metal strip. However, it has been found that degrees of rolling-down of more than 50% make further processing of the metal more difficult and are only possible with very soft grades of steel.

In the regions of the hot-rolled strip which are of a smaller thickness, the degree to which they have been rolled down after the cold rolling is preferably 0% to 10%. Where the degree of rolling-down is 0%, these regions of the metal strip remain unrolled and do not undergo any additional strengthening. As well as this, a moderate rise in for example the tensile strength can be achieved by setting the degree of rolling-down in the cold rolling in these regions to a maximum of 10%. The desired tensile strength, yield point and/or elongation at rupture can thus be set by way of the degree of rolling-down, as dictated by the material.

Finally, a further improvement can be made to the method according to the invention by cutting blanks to size from the metal strip after the cold rolling and the optional application of an organic and/or inorganic coating to the fully rolled metal strip. The cutting to size of the blanks may take place immediately following the cold rolling or immediately following any coating operations for which provision is made. However, it is also conceivable for the metal strip first to be wound into a coil, for it later, as an option, to be coated, and for blanks then to be cut to size from the metal strip.

Ultimately, the above-mentioned object is also achieved by the use of a blank according to the invention in vehicle construction, motor vehicle construction and railway vehicle construction, preferably as a formed structural component. Because it is possible for the blank to be suitably designed for its loads, for a unitary material to be used, and for varying strengths nevertheless to be made available while the wall thickness remains constant, the blank can be adapted particularly well to use in vehicle construction or to the structural component. The use also makes it possible for components, i.e. structural components, which are suitably designed for their loads to be produced particularly inexpensively. As well as this, recycling is also considerably improved by the use of a blank made of a single material.

BRIEF DESCRIPTION OF THE DRAWINGS

The invention is explained in detail below by reference to the drawings and to the description of exemplary embodiments. In the drawings.

DETAILED DESCRIPTION OF THE INVENTION

Figure 1:
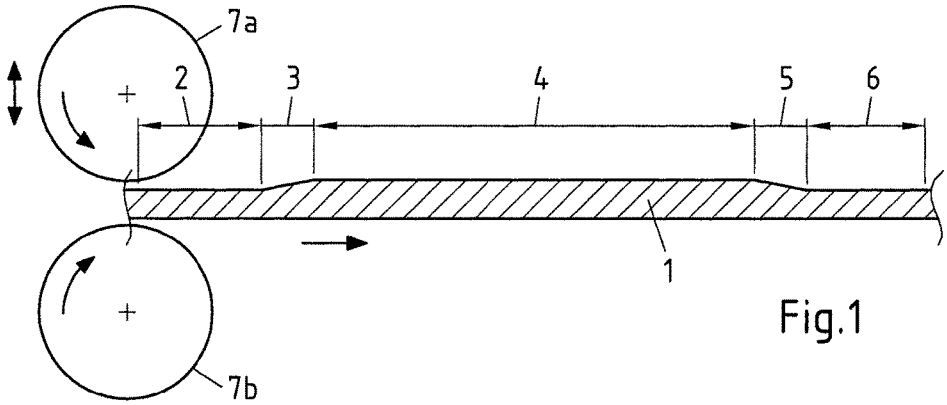
FIG. 1 is a longitudinal section showing, in section, the shape of a hot-rolled strip after flexible hot rolling and showing, schematically, the corresponding use of working rolls in the hot rolling.

Shown in FIG. 1 is hot-rolled strip 1 which has been hot rolled by means of the working rolls 7*a*, 7*b* by changing the roll gap during the rolling, thus producing regions 2, 3, 4, 5, 6 which have various thicknesses. In the transitional regions 3, 5 between the regions 2, 4, 6, there is a continuous change in the thickness of the metal strip 1. As can be seen from FIG. 1, the change in thickness can for example be made simply by changing the position of one working roll. It is however also conceivable for the positions of both the working rolls 7*a*, 7*b* to be displaceable.

In the present exemplary embodiment, the material "X-IP1000" was selected for the hot-rolled strip which, as well as iron, has a carbon content of 0.6% by weight, a manganese content of 22% by weight and a silicon content of 0.2% by weight as its main alloying constituents. This steel is thus one of the high manganese steels. However, as already mentioned, in principle all grades of steel are suitable for providing tensile strengths, yield points and/or elongations at rupture which vary as a result of strengthening during cold rolling.

In the first exemplary embodiment, the transitional regions 3, 5 are selected to be of a length of 50 mm, wherein the regions 2, 6 where the thickness of the hot-rolled strip is reduced each have a length of 200 mm and the region 4 where the wall thickness is increased has a length of approximately 800 mm. The wall thicknesses envisaged are for example 1.8 mm in the regions where the wall thickness is reduced and 2 mm in the regions of greater wall thickness. As the second exemplary embodiment shows, other length ratios may of course be selected.

Figure 2:
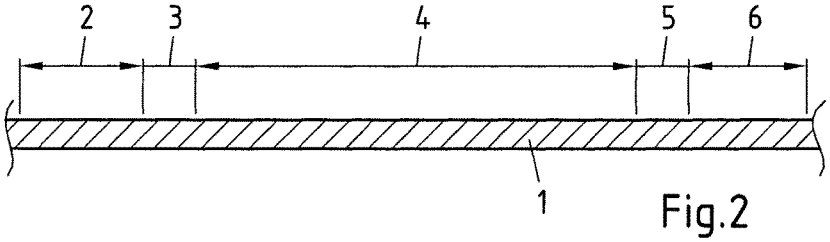
FIG. 2 is a longitudinal section through a first exemplary embodiment of metal strip according to the invention, after the cold rolling.

FIG. 2 shows the hot-rolled strip shown in FIG. 1 after the cold rolling. The thickness of the metal strip 1 after the cold rolling is a constant 1.8 mm in the present exemplary embodiment and the degree to which the region of increased wall thickness 4 has been rolled down is thus approximately 10%. The degrees to which all the other regions have been rolled down is less than 10%, i.e. is 0%. In the transitional regions 3, 5 there is a continuous increase in wall thickness towards the region 4 of the metal strip and because of this after cold rolling there is also a continuous change in the degree of rolling-down, and hence in the mechanical properties such for example as the tensile strength, yield point and/or elongation at rupture, in these regions.

Figure 3:
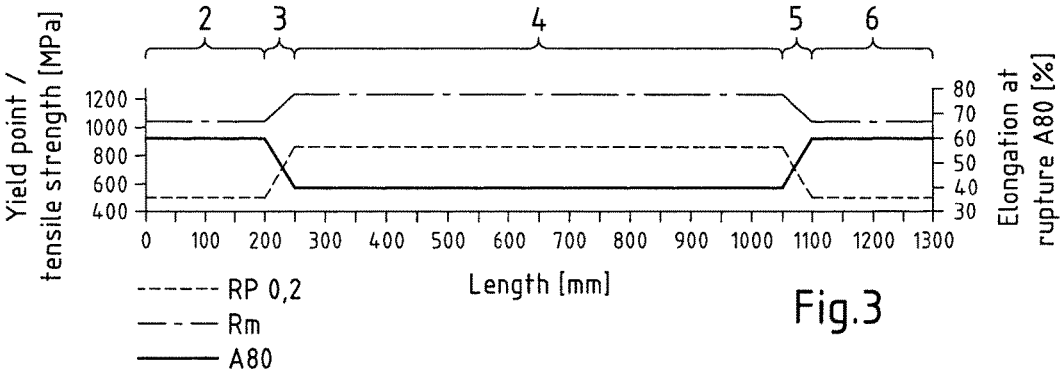
FIG. 3 is a graph of the associated tensile strength, yield point and elongation at rupture of the first exemplary embodiment of metal strip.

This can be seen from the graph in FIG. 3. In the region 2, the tensile strength is initially more than 1000 MPa, which corresponds to the starting state at a degree of rolling-down of 0%, and in the transitional region 3 it rises to approximately 1200 MPa. In the region 4 where the degree of rolling-down was at a maximum, the tensile strength remains at more than 1200 MPa and only in the region 5 does it decline towards the original value, which is reached in the region 6. The yield point behaves in a similar way, with the change in the yield point at a degree of rolling-down of 10% being even more clearly apparent because in this region where the degree of rolling-down was higher there has been an increase in the yield point from 500 MPa to approximately more than 800 MPa. The changes produced by the strengthening very much depend on the material, which means that the values shown should be considered specific to the "X-IP1000" material.

Hence, what are produced by the flexible rolling are transitional regions in which the mechanical properties and, as FIG. 3 also shows, the elongation at rupture, change continuously. The relative changes are dependent in this case on the material which is used to produce the metal strip 1 according to the invention. Hence, in the metal strip 1 according to the invention there is then an alternation between sections where the tensile strength and yield point are increased while the elongation at rupture is reduced and regions where the elongation at rupture is higher and tensile strength is lower and so too is the yield point. Provision is preferably made for a periodic arrangement of these regions, thus enabling identical blanks to be produced easily from the metal strip.

Figure 4:
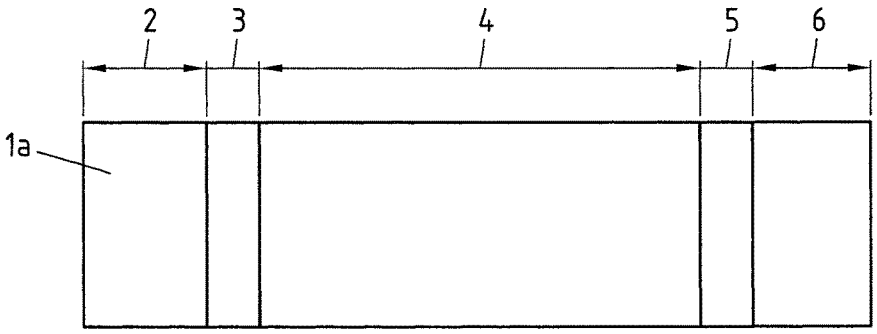
FIG. 4 is a plan view of a blank produced from the first exemplary embodiment of metal strip.

Such a blank is shown for example in plan in FIG. 4. The blank may for example be of a width of 400 mm and a length of 1300 mm. The regions 2 and 6 of reduced tensile strength and yield point and increased elongation at rupture are 200 mm long whereas the transitional regions 3, 5 which are arranged between regions 2 and 4, and 4 and 6, respectively of the blank are of a length of only 50 mm.

Figure 5:
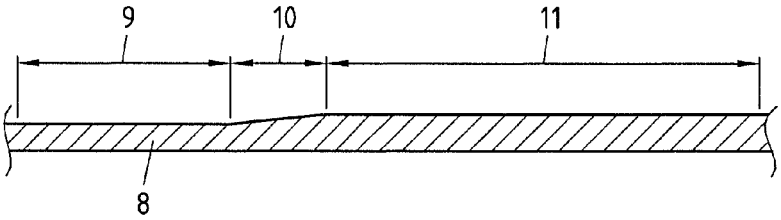
FIG. 5 is a longitudinal section through further hot-rolled strip which is used to produce a second exemplary embodiment of metal strip according to the invention.
Figure 6:
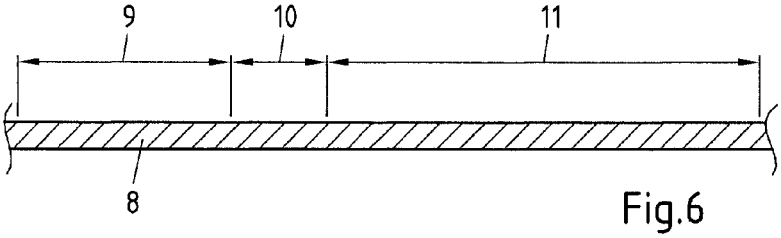
FIG. 6 is a longitudinal section through a second exemplary embodiment of metal strip according to the invention, which is produced from the hot-rolled strip shown in FIG. 5.
Figure 7:
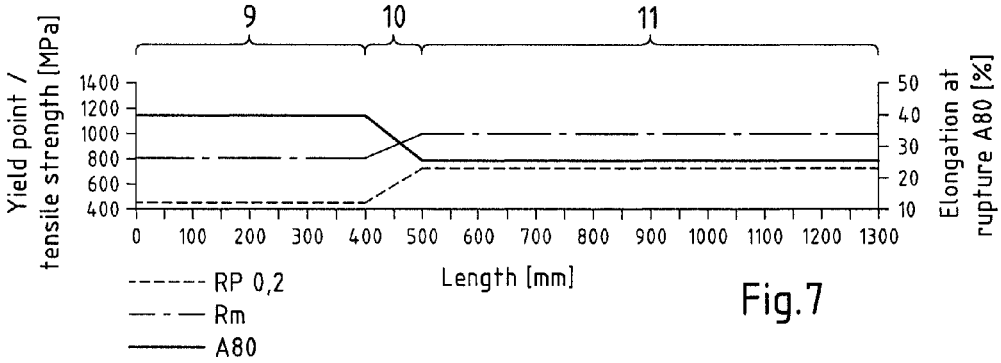
FIG. 7 is a graph of the associated tensile strength, yield point and elongation at rupture of the second exemplary embodiment.

A further exemplary embodiment is elucidated in FIGS. 5 to 8. What is shown first, in FIG. 5, is a flexibly cast hot-rolled strip 8 of a grade 1.4318 stainless steel which provides regions 9, 10, 11 of different thicknesses. In the region 9 for example the thickness of the hot-rolled strip 8 is 1.7 mm and in the region 11 it is 1.9 mm. After the cold rolling to a final thickness of 1.62 mm, the region 9 of the metal strip 8 has been rolled down with a degree of rolling-down of 5%, as FIG. 6 shows. In the transitional region 10, the degree of rolling-down then rises to 15%, as is reached for example in the region 11. Because of these different degrees of rolling-down, which on the one hand are 5% or more, the cold-rolled strip which is produced in this way achieves on the one hand properties which are considerably changed in comparison with the starting product before the cold rolling step (when $Rp_{0.2}$=340 MPa, $R_m$=730 MPa and $A_{80}$=48%) and on the other hand properties which vary considerably between the individual regions in which the degrees of rolling-down differ. This can once again be seen from the graph, in FIG. 7, in which the tensile strength, yield point and elongation at rupture of the material in the different regions are shown.

Figure 8:
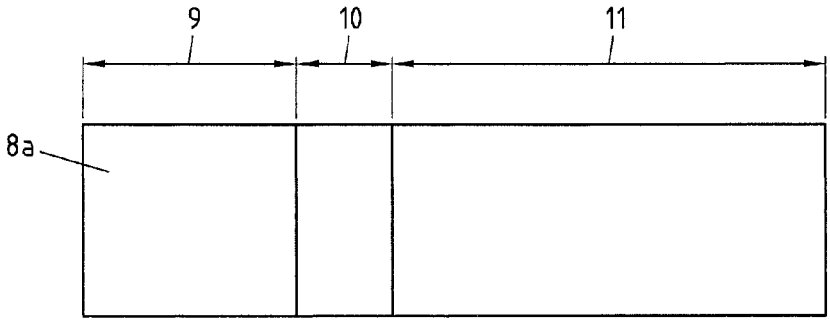
FIG. 8 is a plan view of a blank according to the invention produced from the metal strip shown in FIG. 6.

A plan view of the blank is then shown in FIG. 8. The blank 8*a* has a region rather more than 400 mm long in which the degree of rolling-down is relatively low and in which lower tensile strengths and yield points are obtained with an improved elongation at rupture. The transitional region 10 of the blank, which measures at least 100 mm, has a tensile strength and yield point which increase continuously and which finally move up to the values for the more severely rolled down region 11 of the blank. The region whose degree of rolling-down was as high as possible may for example be approximately 900 mm long.

The blanks according to the invention which are shown in FIG. 4 and FIG. 8 may be processed into components for vehicle construction, in particular into structural components (not shown), wherein they are optimally adapted to the specific loads. For reasons of corrosion protection for example, the blanks may also be provided with an organic and/or inorganic coating (not shown), for example a galvanised coating, before or after the forming into a component.

The invention claimed is:

1. A metal strip comprising: steel and produced by hot rolling and by cold rolling of the metal strip, wherein after the cold rolling the metal strip is of constant thickness and has, section by section, regions whose mechanical properties vary; and, wherein the metal strip to be cold rolled is produced by one of flexible hot rolling, by flexible casting or by flexible cold rolling with subsequent annealing, the metal strip thus having regions of varying thicknesses before the cold rolling, and the regions of varying thickness thus having varying degrees of rolling-down after the cold rolling.

2. The metal strip according to claim 1, wherein the regions whose mechanical properties vary have different tensile strengths, yield points and/or elongations at rupture.

3. The metal strip according to claim 1, wherein there are arranged, between the regions of the metal strip whose mechanical properties vary, transitional regions in which the mechanical properties, and in particular the tensile strengths, yields points and/or elongations at rupture, at least partially change continuously.

4. The metal strip according to claim 1, wherein the thickness of the metal strip is 0.5 mm to 3 mm.

5. The metal strip according to claim 1, wherein the metal strip consists of one of manganese steels, stainless steels, retained-austenite steels or dual-phase steels.

6. The metal strip according to claim 5, wherein the metal strip has at least one of an organic or inorganic coating.

7. The metal strip of claim 5 wherein the manganese content is 22% by weight.

8. A blank produced from the metal strip according to claim 1, wherein the blank is of constant thickness, consists of a single steel material and has, section by section, regions whose mechanical properties vary.

9. The blank according to claim 8, wherein, between the regions whose mechanical properties vary, the blank has transitional regions in which the mechanical properties at least partially change continuously.

10. The blank according to claim 8, wherein the regions whose mechanical properties vary have different tensile strengths, yield points and/or elongations at rupture.

11. A method of use of a blank according to claim 8 in vehicle construction, motor vehicle construction and railway vehicle construction.

12. The method of use of a blank according to claim 11, wherein the blank is a formed structural component.

13. A method of producing steel metal strip according to claim 1, in which a metal strip having regions in which the thickness of the metal strip varies is produced from one of a steel slab by flexible hot rolling, by flexible casting or by flexible cold rolling with subsequent annealing, and the metal strip is cold rolled to a constant final thickness.

14. The method according to claim 13, wherein, in the regions of the metal strip of greater thickness, the degree of rolling-down in the final cold rolling is up to 50%.

15. The method according to claim 14, wherein the degree of rolling-down in the final cold rolling is up to 20%.

16. The method according to claim 13, wherein, in the regions of the metal strip of smaller thickness, the degree of rolling-down in the final cold rolling is 0% to 10%.

17. The method according to claim 13, wherein blanks are cut to size from the metal strip after the final cold rolling and the optional application of an organic and/or inorganic coating to the fully rolled metal strip.

18. The metal strip of claim 1 wherein the regions of varying thickness are in periodic arrangement.

* * * * *